United States Patent [19]

Beausoleil

[11] 4,383,518

[45] May 17, 1983

[54] HEATING STOVE

[76] Inventor: Gabriel Beausoleil, 5060 Ch. du Lac, St. Gabriel de Brandon, Canada, J0K 2N0

[21] Appl. No.: 216,441

[22] Filed: Dec. 15, 1980

Related U.S. Application Data

[63] Continuation-in-part of Ser. No. 31,193, Apr. 18, 1979, abandoned.

[51] Int. Cl.[3] ..... F24B 5/00

[52] U.S. Cl. ..... 126/79; 126/77; 126/61; 126/123

[58] Field of Search ..... 126/77, 120, 121, 122, 126/79, 75, 61, 67, 63, 123; 110/310

[56] References Cited

U.S. PATENT DOCUMENTS

| | | | |
|---|---|---|---|
| 722,067 | 3/1903 | Wilson | 126/75 |
| 923,347 | 6/1909 | Farquhar | 126/112 X |
| 1,552,309 | 9/1975 | Kandle | 110/310 X |
| 2,549,788 | 4/1951 | Fellows | 126/77 X |
| 3,952,721 | 4/1976 | Patterson | 126/120 X |
| 4,030,479 | 6/1977 | Webb | 126/287 |
| 4,192,285 | 3/1980 | Neitupski | 126/83 |

FOREIGN PATENT DOCUMENTS

| | | |
|---|---|---|
| 70067 | 1/1901 | Canada . |
| 138117 | 1/1912 | Canada . |

*Primary Examiner*—Larry Jones

[57] ABSTRACT

A slow combustion stove is disclosed. The stove comprises a stove body adapted to receive fuel, such as wood, on the bottom to form a fire bed, an adjustable air intake for admitting air into the stove body, an exhaust duct, a smoke outlet located adjacent the top of the furnace body and communicating with the exhaust duct, a smoke flue located adjacent the bottom of the furnace body and also communicating with the exhaust duct, and damper means permitting exhaust of the combustion gases through the smoke outlet during starting of the fire and through the fire bed and the smoke flue when the fire is well lit to ensure maximum fuel and gas combustion.

3 Claims, 5 Drawing Figures

HEATING STOVE

This application is a continuation-in-part of application Ser. No. 031,193, filed Apr. 18, 1979, now abandoned.

This invention relates to a heating stove, more particularly, a slow combustion stove and using solid fuel such as wood or coal.

Heating wood stoves are, of course, well known. However, it has always been difficult to regulate the amount of air fed to such stoves and so control fuel consumption. As it is well known, too little air prevents complete fuel combustion and thus leaves a lot of ashes in the stove. Incomplete combustion also produces carbon monoxide which is a toxic gas. On the other hand, too much air causes rapid combustion and a great loss of heat is lost through the stove pipe and chimney. Slow combustion stoves are also known, in which the air fed can be maintained to the minimum required, however the combustion gases often fail to burn in the stove and potential useful heat is lost to the chimney.

It is therefore the object of the present invention to provide a heating stove whose major characteristics reside in the complete combustion of fuel leaving a minimum quantity of ashes and in a relatively slow combustion rate ensuring low temperature flue gases.

The heating stove, in accordance with the invention, comprises a stove body adapted to receive fuel, such as wood, on the bottom to form a fire bed, an adjustable air intake for admitting air into the stove body, an exhaust duct having a top opening for connection with a stove pipe, a smoke outlet located adjacent the top of the furnace body and communicating with the exhaust duct, a smoke flue located adjacent the bottom of the furnace body and also communicating with the exhaust duct, and damper means permitting exhaust of the combustion gases through the smoke outlet during starting of the fire, and through the fire bed and the smoke flue when the fire is well lit to ensure maximum fuel and gas combustion.

The smoke flue preferably extends along the bottom of the stove body from the exhaust duct to the fire bed. The smoke flue is preferably of a smaller cross-section than that of the top opening of the exhaust duct and is also preferably lined with refractory material.

The damper means may be a rocking damper which, in one extreme position, nearly closes the smoke flue and fully opens the smoke outlet to the exhaust duct, and, in the other extreme position, fully closes the smoke outlet and fully opens the smoke flue to the exhaust duct.

The heating stove may be provided with outer side panels located at a predetermined distance from the furnace body and a grill bridging the side panels for permitting circulation of warm air upwardly along the walls of the furnace and through the grill. The grill is preferably removable for placing a pot or kettle directly on the stove body when needed.

The invention will now be disclosed, by way of example, with reference to a preferred embodiment illustrated in the accompanying drawings in which.

Figures 1, 2, 3:
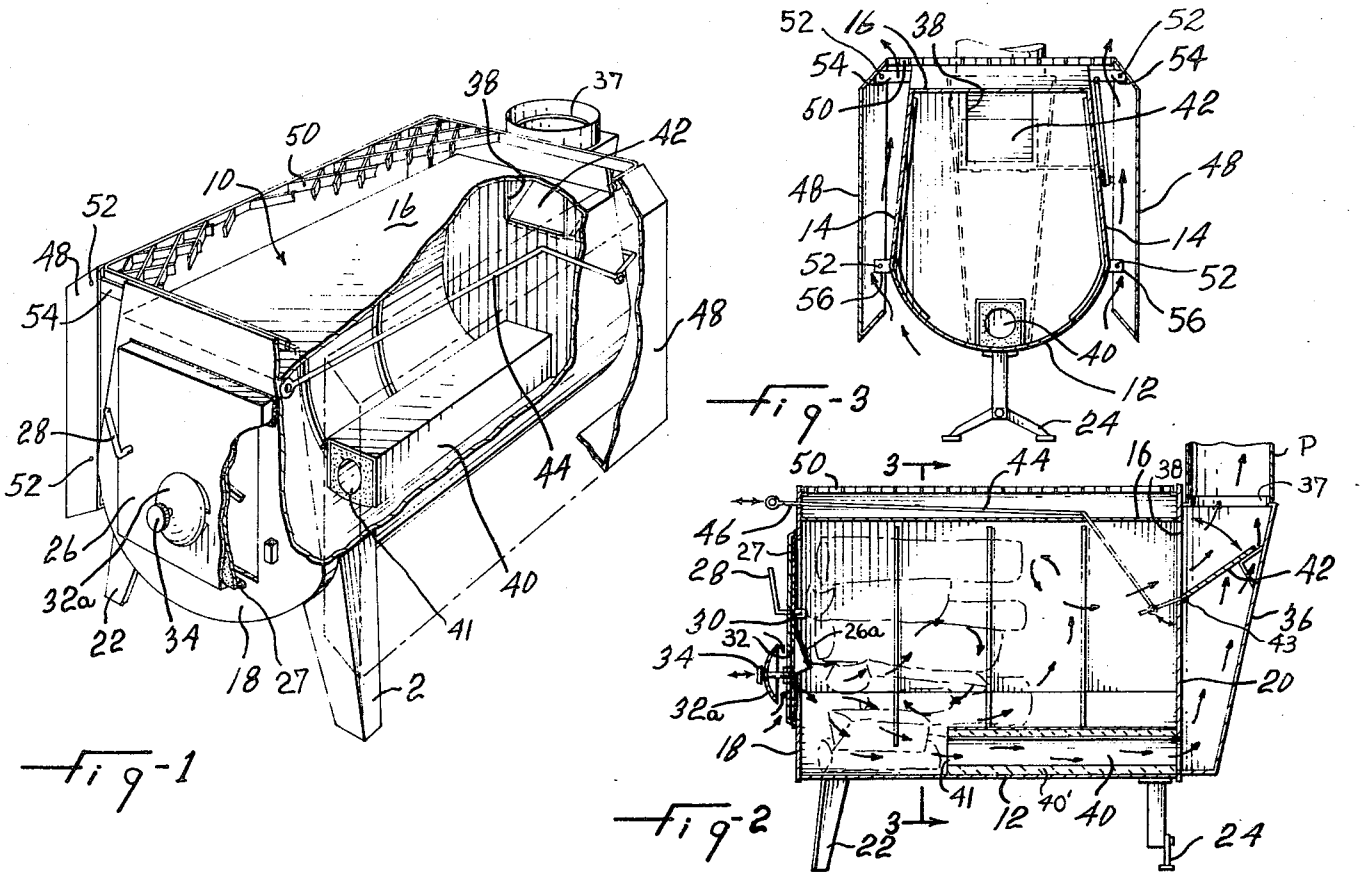
FIG. 1 illustrates a perspective view, partly in broken section, of a heating stove in accordance with the invention.
FIG. 2 illustrates a longitudinal section view through the stove shown in FIG. 1 but showing the damper control bar in full elevation.
FIG. 3 illustrates a section view taken along line 3—3 of FIG. 2.
Figure 5:
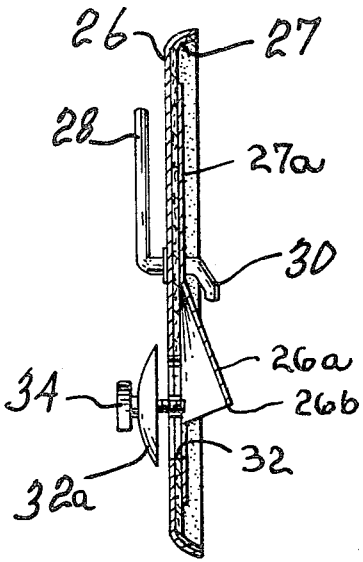
FIG. 5 is a cross-section taken along line 5—5 of FIG. 4.
Figure 4:
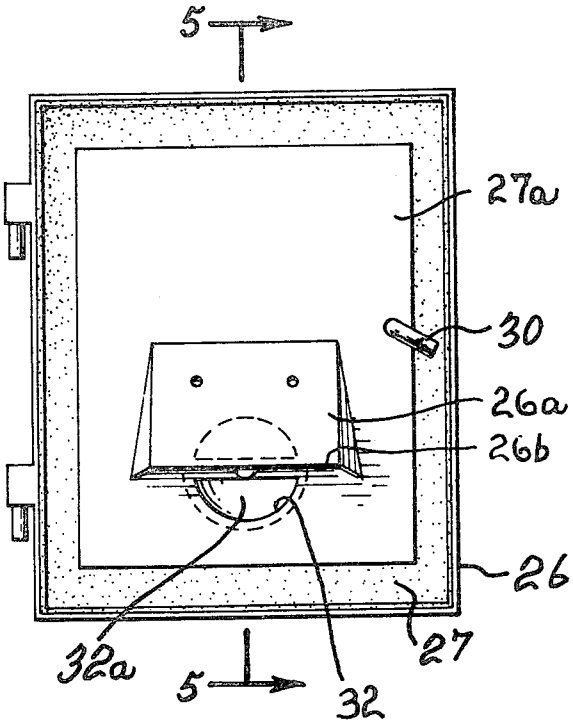
FIG. 4 is an elevation of the inside face of the stove door.

Referring to the drawings, there is shown a stove comprising a horizontal body 10 having a bottom wall 12, side walls 14, a flat, horizontal top wall 16 and front and rear end walls 18 and 20, respectively. The stove body is supported above ground by a pair of front legs 22 and by a single back swivel leg 24 which permits to more efficiently stabilize the stove on an uneven floor. The front of the stove is provided with a door 26 for loading fuel, such as wood. The door 26 has an inner asbestos sheet lining 27 retained by a metal plate **27*a* secured to door 26, and is closed by a rotating handle 28 provided with a catch 30 engaging the inside frame of the door to permit tight, practically air-proof, closure of the door on the door frame. A circular air intake opening 32 is made in door 26 and is adjustably closed by a closure 32*a* mounted on an adjustment bolt 34. An air deflector 26*a* is secured to plate 27*a* on the inside face of door 26. Deflector 26*a* is downwardly inwardly inclined to deflect the incoming air downwardly towards the bottom wall 12. Preferably, the bottom edge 26*b* of deflector 26*a* is located in register with the center of opening 32**.

The back end wall 20 of the stove is provided with an upright gas exhaust duct 36 having a top opening 37 for connecting a stove pipe P. Exhaust duct 36 communicates with a smoke outlet 38 located adjacent the top of the stove body and with a smoke flue 40 located on the bottom wall 12 of the stove body. Smoke outlet 58 has a free cross-sectional area substantially equal to that of top opening 37. Smoke flue 40 has an inlet 41 preferably located in the front half portion of the combustion chamber formed by body 10, preferably spaced 10 to 12 inches from the front wall 18 for better efficiency. It has an inner lining 48' of refractory material to resist the high combustion temperature. The inside cross-section of smoke flue 40 is smaller than that of top opening 37 and stove pipe P. Preferably, the free cross-sectional area of smoke flue 40, specifically of its inlet 41, is between 4 and 8 times smaller than that of opening 37 and of smoke outlet 38. A rocking damper 42 is pivoted at 43 on the rear wall 20 of the stove and operated by a control bar 44 extending along the outside of body 10 and having notches 46 engaging the wall of an opening in the front end wall 18 of the stove body to control the position of the rocking damper within the exhaust duct. As it will be easily seen, pushing of the bar to its extreme position will permit complete closing of the smoke outlet 38, whereas pulling of the bar in the other direction will nearly completely close the smoke flue 40. Positioning of the bar at intermediate positions will control the relative flows of top and bottom exhaust gases.

The stove is provided with side panels 48 spaced from the side walls of the stove and with a top grill 50 bridging the upper edges of the panels. This permits better heat exchange between hot body 10 and room air upward flowing through the grill and also prevents accidental burning of people and clothes on the hot walls of the stove body. The grill may be used as a plate warmer. It may also be removed for direct placing of a pot or kettle on the top wall 16 of the stove body if needed. It is also preferable to have the side walls of the stove body inclined inwardly at the top so as to leave more space between the walls of the stove body and the side panels to accommodate air expansion as it heats while passing upwardly near the hot side walls of the stove. Side panels 48 are secured at 52 to brackets 54 and 56, themeselves secured to the stove body and laterally extending therefrom.

The above disclosed stove operates as follows:

When the fire is started, the control bar 44 is pulled to the extreme position to fully open the smoke outlet 38 and practically close the bottom smoke flue 40. Thus, one takes advantage of the full draft capacity of the chimney. The stove is loaded with paper and small pieces of wood to start the fire. The fire is lit, the air intake 322 opened substantially, and the door of the stove closed.

When the fire is well lit, the stove is fully loaded with regular fire logs. When the chimney is sufficiently heated to obtain proper draft, the control bar 40 can then be pushed fully to close smoke outlet 38 and to communicate the smoke flue 40 with the exhaust duct. This will cause the combustion air and volatile gases to completely pass through the fire bed before entering the bottom smoke flue; this maintains the fire bed at a high temperature and so ensure full combustion of the wood cinders. This will also ensure full combustion of the volatile gases before they reach the exhaust duct 36 leaving only water vapors and $CO_2$ go up the stove pipe and the chimney. The small cross-sectional area of smoke flue 40 with respect to stove pipe P and the fact that the inlet 41 of flue 40 is situated in the fire bed enables to produce high coombustion air velocity within the fire bed resulting in high bed temperature while allowing a low mass flow of the hot gases through flue 40 and the chimney. The latter can thus be maintained at the minimum temperature required to produce the necessary draft. Minimum heat is lost though the chimney. The temperature of the chimney, under normal conditions, should be maintained between 225° F. and 275° F. Since this is highly dependent on the type of chimney (inside or outside, insulated or not insulated), the velocity of the wind and the degree of heating, the user will have to determine the optimum opening of the damper 42 depending on the prevailing conditions. A thermometer may be mounted on the chimney to measure the temperature of the chimney.

The degree of heating of the furnace is done in the usual manner by controlling the opening of the air intake 32. If the stove seems to choke for a certain opening of the air intake 32, the damper control bar is pulled to slightly open the upper smoke outlet and close the lower smoke flue.

Air deflector **26*a*** feeds combustion air more directly through the fire bed resulting in very slow burning of the logs piled up in the upper portion of the combustion chamber. These legs gradually fall down as the bottom layer of wood becomes totally consumed.

The stove is very efficient since it has been found that a load of wood logs may last 8 to 12 hours while heating a standard 6 room bungalow in average −10° C. weather.

Although the invention has been disclosed with reference to a preferred embodiment, it is to be understood that it is not limited to such embodiment and that other alternatives are also envisaged. For example, the shape of the stove body may vary. The damper 42 in the exhaust duct need not be a rocking damper. As a matter of fact, two separate dampers could be used, one for the upper smoke outlet and one for the lower smoke flue. Finally, the side panels could be eliminated although this heats the room air more efficiently, is a safety feature which is worthwhile, and, in addition, permits channelling of the warm air through the top grill for plate warming when needed.

What I claim is:

1. A heating stove comprising:

(a) a stove body having top, bottom, front and rear walls and adapted to receive solid fuel, such as wood, on the bottom wall to form a fire bed, said front wall having a fuel loading opening and a door to close said opening;

(b) an adjustable air intake for admitting air into the stove body located in said door adjacent and above said bottom wall;

(c) an upright exhaust duct having a top opening for connection with a stove pipe and located exteriorly of said rear wall;

(d) a smoke outlet located at said rear wall, adjacent the top of the stove body and communicating with the exhaust duct, said smoke outlet having a free cross-sectional substantially equal to that of said top opening;

(e) a smoke flue in the form of a substantially horizontal tube extending within the stove body from said rear wall towards said front wall, located adjacent and above the bottom wall of the stove body and also communicating with the bottom of said exhaust duct, said smoke flue having an inlet located adjacent and above the bottom wall in the front half portion of the distance between said front and rear walls, and intermediate said front and rear walls, said inlet facing said front wall and freely opening within said stove body, said inlet having a free cross-sectional area between four and eight times smaller than the cross-sectional area of said top opening and of said smoke outlet; and (f) damper means permitting exhaust of the combustion gases through the smoke outlet during starting of the fire, and through the fire bed and the smoke flue when the fire is well lit to ensure maximum fuel and gas combustion.

2. A heating stove as defined in claim 1, wherein said damper means is a rocking damper located in said exhaust duct and which, in one extreme position, nearly closes said smoke flue to said top opening and fully opens said smoke outlet to the exhaust duct, and, in its other extreme position, fully closes said smoke outlet and fully opens said smoke flue to said top opening.

3. A heating stove as defined in claim 1 or 2, wherein said adjustable air intake has a downwardly inclined air deflector for directing the incoming air towards the bottom wall of the furnace body and towards the inlet of said smoke flue.

* * * * *